US008741533B2

(12) United States Patent
Yamada

(10) Patent No.: US 8,741,533 B2
(45) Date of Patent: Jun. 3, 2014

(54) METHOD OF MANUFACTURING TONER

(71) Applicant: Hiroshi Yamada, Shizuoka (JP)

(72) Inventor: Hiroshi Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 30 days.

(21) Appl. No.: 13/669,685

(22) Filed: Nov. 6, 2012

(65) Prior Publication Data

US 2013/0130174 A1 May 23, 2013

(30) Foreign Application Priority Data

Nov. 22, 2011 (JP) ..... 2011-254503

(51) Int. Cl.
*G03G 9/08* (2006.01)

(52) U.S. Cl.
USPC ..... 430/137.14

(58) Field of Classification Search
USPC ..... 430/137.14
See application file for complete search history.

(56) References Cited

U.S. PATENT DOCUMENTS

| | | | |
|---|---|---|---|
| 2003/0027074 | A1 | 2/2003 | Emoto et al. |
| 2003/0096185 | A1 | 5/2003 | Yamashita et al. |
| 2004/0234882 | A1 | 11/2004 | Matsui et al. |
| 2007/0184370 | A1 | 8/2007 | Yamashita et al. |
| 2009/0226836 | A1 | 9/2009 | Uchinokura et al. |
| 2011/0177440 | A1 | 7/2011 | Yamada et al. |

FOREIGN PATENT DOCUMENTS

| | | |
|---|---|---|
| JP | 9-015903 | 1/1997 |
| JP | 11-133665 | 5/1999 |
| JP | 11-149180 | 6/1999 |
| JP | 2000-292981 | 10/2000 |
| JP | 2001-092180 | 4/2001 |
| JP | 2002-055484 | 2/2002 |
| JP | 2005-010723 | 1/2005 |
| JP | 2005-049858 | 2/2005 |
| JP | 2006-208624 | 8/2006 |

*Primary Examiner* — Hoa V Le

(74) *Attorney, Agent, or Firm* — Oblon, Spivak, McClelland, Maier & Neustadt, L.L.P.

(57) ABSTRACT

A method of manufacturing toner is provided. The method includes preparing a first liquid by dissolving or dispersing toner components in an organic solvent, preparing a second liquid by emulsifying the first liquid in an aqueous medium, and evaporating the organic solvent from the second liquid. The toner components include a colorant, a release agent, and one or both of a binder resin and a precursor thereof. The evaporating includes flowing down the second liquid as a liquid film in substantially a vertical direction along an inner wall surface of a pipe that is depressurized, heating the liquid film at a temperature not higher than a glass transition temperature of the binder resin, and supplying the pipe with a depressurized water vapor from a supply opening disposed on an upper part of the pipe.

4 Claims, 3 Drawing Sheets

METHOD OF MANUFACTURING TONER

CROSS-REFERENCE TO RELATED APPLICATIONS

This patent application is based on and claims priority pursuant to 35 U.S.C. §119 to Japanese Patent Application No. 2011-254503, filed on Nov. 22, 2011, in the Japan Patent Office, the entire disclosure of which is hereby incorporated by reference herein.

BACKGROUND

1. Technical Field

The present disclosure relates to a method of manufacturing toner for use in electrophotographic image forming apparatuses such as copier, laser printers, and facsimile machines.

2. Description of Related Art

To meet increasing demand for higher image quality, electrophotographic toners have been developed to have a narrower size distribution and a spherical shape. Because spherical toner particles with a narrow size distribution each behave in the same manner when developing an electrostatic image, the resulting toner image has high microdot reproducibility. In particular, spherical toner particles having a narrow size distribution and a small particle diameter are difficult to reliably remove with a blade member when they are undesirably remaining on an image bearing member.

By contrast, irregular-shaped toner particles, generally having low fluidity, are easy to remove with a blade member. However, because such irregular-shaped toner particles behave unstably when developing an electrostatic image, the resulting toner image has low micro-dot reproducibility. Because irregular-shaped toner particles are transferred onto a transfer medium at a low filling rate, the resulting toner layer on the transfer medium has a low thermal conductivity. Such a toner layer having a low thermal conductivity cannot be fixed on the transfer medium at low temperatures, especially when fixing pressure is relatively small.

JP-H09-15903-A discloses a method of manufacturing toner including steps of mixing a binder resin and a colorant in a water-immiscible solvent, dispersing the resulting composition in an aqueous medium in the presence of a dispersion stabilizer, removing the solvent from the resulting suspension by applying heat and/or reducing pressure to form irregularities on the surfaces of the resulting particles, and spheroidizing or deforming the particles by applying heat. The resulting toner particles may have unstable chargeability because their shapes are irregular.

JP-2005-49858-A discloses a method of manufacturing toner including steps of dispersing a solvent dispersion comprising a resin and/or a precursor thereof and a filler in an aqueous medium to prepare a W/O dispersion, and removing the solvent from the W/O dispersion to prepare resin particles. The W/O dispersion includes oil droplets, each of which includes an accumulation layer of the filler. The resulting toner particles may be easily removable with a blade member (hereinafter "cleanability") because they have irregular shapes due to the presence of the accumulation layer of the filler on their surface. However, such toner particles may not be fixed on a recoding medium at low temperatures due to the presence of the accumulation layer of the filler on their surface.

JP-2005-10723-A discloses a method of manufacturing toner including steps of dispersing an organic solvent solution or dispersion of toner components in an aqueous medium, introducing the resulting emulsion to a continuous vacuum defoaming device, and removing the organic solvent from the emulsion by applying shearing force. The resulting toner particles may be easily removable with a blade member, and may cause neither toner scattering in text images nor deterioration of line image reproducibility. However, in order to obtain spherical toner particles having a small particle diameter and a narrow particle diameter distribution, this method may be required to further improve the efficiency of organic solvent removal.

JP-H11-133665-A discloses a method of manufacturing toner including steps of dissolving binder resins comprising a urethane-modified polyester (i) and an unmodified polyester (ii) in a solvent, and dispersing the resulting solution in an aqueous medium. JP-H11-149180-A discloses a method of manufacturing toner including steps of elongating and/or cross-linking a polyester prepolymer (A1) having an isocyanate group with an amine (B) in an aqueous medium to obtain a resin (i). The resulting toner includes the resin (i) and another resin (ii) inactive with either (A1) or (B) as binder resins.

JP-2000-292981-A discloses a method of manufacturing toner in an aqueous medium. The resulting toner includes a high-molecular-weight resin (A) and a low-molecular-weight resin (B).

Each of the publications JP-H11-133665-A, JP-H11-149180-A, and JP-2000-292981-A describes that the resulting toner has a good combination of heat-resistant storage stability, low-temperature fixability, hot offset resistance, and image gloss.

JP-2002-55484-A discloses a method including subjecting a polymerizable monomer composition including a polymerizable monomer and a colorant to a polymerization in an aqueous medium to produce colored polymer particles, washing the colored polymer particles, removing water therefrom to obtain toner particles, containing the toner particles in a container that can be depressurized or heated, and subjecting the toner particles to a depressurizing-heating treatment by supplying saturated water vapor, superheated water vapor, or high-humidity air to the container so that unreacted polymerizable monomers are removed.

JP-2001-92180-A discloses a method including subjecting a polymerizable monomer composition including a polymerizable monomer and a colorant to a polymerization in an aqueous medium in the presence of a polymerization initiator, and introducing the air or an inert gas into a distillation apparatus so that unreacted polymerizable monomers are removed.

JP-2006-208624-A discloses a method including dispersing a polymerizable monomer composition including a polymerizable monomer in a dispersion medium, introducing a carrier gas to a polymer dispersion liquid obtained during the latter half or after the polymerization so that organic volatile components are removed from the polymer dispersion liquid.

However, in order to industrially manufacture spherical toner particles having a small particle diameter and a narrow particle diameter distribution, the above methods may be required to further improve the efficiency of organic solvent removal.

SUMMARY

In accordance with some embodiments, a method of manufacturing toner is provided. The method includes preparing a first liquid by dissolving or dispersing toner components in an organic solvent, preparing a second liquid by emulsifying the first liquid in an aqueous medium, and evaporating the organic solvent from the second liquid. The toner components include a colorant, a release agent, and one or both of a binder resin and a precursor thereof. The evaporating includes flowing down the second liquid as a liquid film in substantially a vertical direction along an inner wall surface of a pipe that is depressurized, heating the liquid film at a temperature not higher than a glass transition temperature of the binder resin, and supplying the pipe with a depressurized water vapor from a supply opening disposed on an upper part of the pipe.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 2:
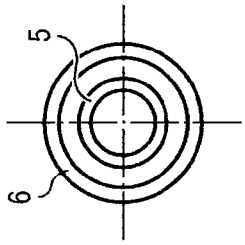
FIG. 2 is an upper schematic view illustrating the inner pipe and the depressurized water vapor supply opening included in the apparatus illustrated in FIG. 1.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

In accordance with some embodiments, a method of manufacturing toner is provided. The method includes: preparing a first liquid by dissolving or dispersing toner components including a colorant, a release agent, and one or both of a binder resin and a precursor thereof in an organic solvent; preparing a second liquid by emulsifying the first liquid in an aqueous medium; and evaporating the organic solvent from the second liquid. The evaporating includes: flowing down the second liquid as a liquid film in substantially a vertical direction along an inner wall surface of a pipe that is depressurized; heating the liquid film at a temperature not higher than a glass transition temperature of the binder resin; and supplying the pipe with a depressurized water vapor from a supply opening disposed on an upper part of the pipe.

In accordance with some embodiments, the precursor includes a compound having an active hydrogen group and a polymer having a functional group reactive with the active hydrogen group. In accordance with some embodiments, the pipe and the supply opening are concentrically disposed in substantially a vertical direction.

The method effectively produces toner having excellent micro-dot reproducibility and cleanability.

According to some embodiments, the second liquid has a viscosity within a range of 50 to 800 mPa·sec when measured with a Brookfield viscometer at a revolution of 60 rpm and a temperature of 25° C. When the viscosity of the second liquid is 50 mPa·sec or more, the second liquid can be easily formed into a uniform liquid film when flowing down in substantially a vertical direction along an inner wall surface of the pipe. When the viscosity of the second liquid is 800 mPa·sec or less, the liquid film does not get too thick to efficiently evaporate the organic solvent.

When the inner pressure of the pipe exceeds 70 kPa, it is difficult to efficiently evaporate the organic solvent. When the temperature of the second liquid flowing down the inner wall surface of the pipe (i.e., the inner temperature of the pipe) exceeds the glass transition temperature of the binder resin, the produced particles in the second liquid are likely to aggregate and accumulate on the inner wall surface, preventing efficient evaporation of the organic solvent. After a continuous operation of such an apparatus for an extended period of time, the pipe may be clogged with the accumulated materials and the operation may be undesirably shut down.

In the method, the pipe is supplied with a depressurized water vapor from a supply opening disposed on an upper part of the pipe. The water vapor is brought into contact with the second liquid flowing down as a liquid film in substantially a vertical direction along an inner wall surface of the pipe. The water vapor gives latent heat to the second liquid when condensing into water so that the organic solvent is volatilized. The organic solvent is volatilized with the water vapor as an azeotropic mixture while the water vapor condenses into water simultaneously. Therefore, the water content in the second liquid does not reduce but rather increases. The increase amount is equivalent to the amount of water producible by condensing water vapor with the energy (i.e., sensible heat and latent heat) needed for evaporating the organic solvent, the energy equivalent to sensible heat released by the azeotropic water, and the energy needed for returning the evaporation equipment to normal temperature. The azeotropic water and condensed water have the same evaporative latent heat. Thus, energy and substances needed for the evaporation are balanced out. Because the water content in the second liquid does not reduce, toner particles produced therein can keep a proper distance with each other. Therefore, the organic solvent can be removed from the second liquid without degrading the particle size distribution of the toner particles.

Generally, a flow velocity of a fluid depends on the diameter of a pipe under a constant flow volume. The greater the cross-sectional area of the pipe, the smaller the flow velocity of the fluid. This is because the fluid receives a greater viscosity resistance from the pipe as the cross-sectional area of the pipe increases. Accordingly, in the method according to an embodiment, in which a liquid film of the second liquid flows down along an inner wall surface of a pipe for evaporating the organic solvent, the flow velocity of the liquid film depends on the cross-sectional area of the pipe. In the method according to an embodiment, the organic solvent is evaporated from the second liquid without disturbing the liquid film flow because the water content in the second liquid does not reduce and toner particles produced therein can keep a proper distance with each other.

In the method according to an embodiment, a depressurized water vapor directly heats the second liquid. Upon contact of the water vapor (that is gaseous) with the second liquid, the water vapor condenses into water (that is liquid) with releasing latent heat and the organic solvent in the second liquid vaporizes. Water at 100° C. has a latent heat of 539 kcal/kg, which is relatively large. Heat exchange accompanied by phase transition is superior to that unaccompanied by phase transition in that a large amount of heat can be exchanged. Compared to a method in which the second liquid is indirectly heated, for example, by flowing a heat medium, such as warm water, between an inner pipe and an outer pipe, the method according to an embodiment in which the second liquid is directly heated by contact with a depressurized water vapor provides better heat transfer efficiency without degrading heat transfer ability. In the method in which the second liquid is indirectly heated with warm water, it is required that the warm water has a higher temperature than the second liquid for efficiently removing the organic solvent. In this case, it is preferred that the temperature of the second liquid is equal to or less than the glass transition temperature of the binder resin for preventing toner particles from aggregating. Thus, the temperature of the warm water is undesirably limited.

Generally, an organic solvent having a boiling point less than 100° C. at one atmospheric pressure has a higher vapor pressure than water. In distillation of a mixture of such an organic solvent with water under reduced pressure, the organic solvent is volatilized first, then an azeotrope of the organic solvent and water is boiled, and finally water is volatilized. The boiling point of the mixture is equal to that of water. In steam distillation, the temperature of the mixture never exceeds the boiling point of water even when the compositional ratio between the organic solvent and water is varied. This means that the upper limit temperature of the mixture to be distilled depends on an operating pressure value under the reduced pressure condition. By controlling the operating pressure value, it is easy to make the second liquid have the same temperature as the glass transition temperature of the binder resin for preventing toner particles from aggregating.

In accordance with some embodiments, the pipe and the supply opening through which a depressurized water vapor is supplied are concentrically disposed in substantially a vertical direction. By concentrically arranging the pipe and the supply opening, the direction of flow of the second liquid coincides with that of the depressurized water vapor, resulting in rectifying effect such that a liquid film flow is uniformly formed along an inner wall surface of the pipe. In a case in which the liquid film flow is disturbed, the inner wall surface gets partially dry rather than getting completely wet. Resulting toner particles are in unstable surface condition and likely to form aggregates which may clog the pipe. If coarse particles produced from the aggregates come to be mixed in the second liquid, reliable production of toner particles is prevented.

Figure 1:
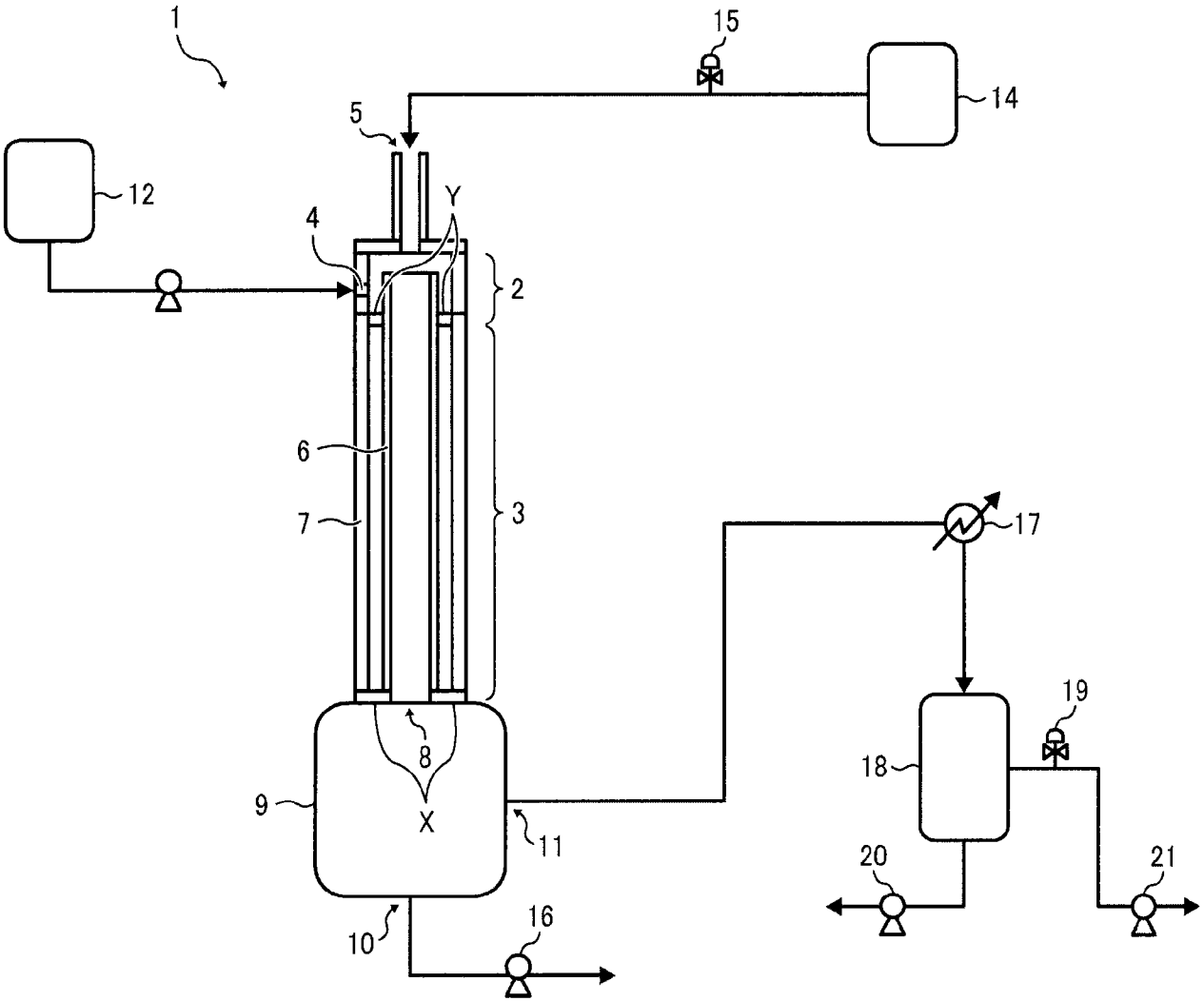
FIG. 1 is a schematic view illustrating a solvent removing apparatus for practicing a method of manufacturing toner according to an embodiment.

FIG. 1 is a schematic view illustrating a solvent removing apparatus for practicing a method of manufacturing toner according to an embodiment.

A solvent removing apparatus 1 illustrated in FIG. 1 includes a supply part 2 and a heating part 3. The apparatus 1 further includes a supply opening 4, a depressurized water vapor supply opening 5, an inner pipe 6, an outer pipe 7, and an inner pipe discharge opening 8. The inner pipe 6 is supplied with a depressurized water vapor through the depressurized water vapor supply opening 5 and an inner wall surface of the inner pipe 6 is heated. The depressurized water vapor has been supplied from a water vapor supply tank 14 and depressurized by a depressurized water vapor pressure regulating valve 15. Further, the inner pipe 6 is depressurized to 70 kPa or less by a vacuum pump 21 during an operation of evaporating organic solvent. The inner pipe 6 is supplied with the second liquid from a supply tank 12 through the supply opening 4 provided on an upper part of the inner pipe 6. The second liquid is formed into a liquid film that flows down in substantially a vertical direction along an inner wall surface of the inner pipe 6. The liquid film of the second liquid is heated by contact with the depressurized water vapor while flowing down along an inner wall surface of the inner pipe 6. The degree of depressurization of the inner pipe 6 is regulated by both the vacuum pump 21 and a pressure regulating valve 19. The second liquid is controlled to have a temperature not higher than the glass transition temperature of the binder resin. The organic solvent can be efficiently removed from the second liquid without causing softening or aggregation of toner particles.

A tank 9 is connected to the inner pipe 6. The organic solvent having been evaporated from the second liquid, in the form of gas, and the second liquid from which the organic solvent has been evaporated, in the form of liquid, both accumulate in the tank 9. After the gas and liquid are separated, the liquid is discharged from a tank discharge opening 10 by a discharge pump 16. The gas is discharged from a vapor outlet 11, condensed by cold water in a condenser 17, accumulated in a condensate liquid tank 18, and discharged therefrom by a condensate liquid discharge pump 20. The supply amount of the depressurized water vapor is regulated by the depressurized water vapor pressure regulating valve 15. The degree of depressurization of the inner pipe 6 is regulated by both the vacuum pump 21 and the pressure regulating valve 19. The temperature for removing organic solvent is adjusted by gas-liquid equilibrium. Thus, the organic solvent is removed from the second liquid at a temperature not higher than the glass transition temperature of the binder resin.

FIG. 2 is an upper schematic view illustrating the inner pipe 6 and the depressurized water vapor supply opening 5.

By concentrically arranging the inner pipe 6 and the depressurized water vapor supply opening 5 as illustrated in FIG. 2, the direction of flow of the depressurized water vapor coincides with that of the liquid film that is flowing down in substantially a vertical direction along an inner wall surface of the inner pipe 6, suppressing disturbance of the liquid film flow.

As described above, the first liquid includes a binder resin and/or a precursor thereof. Alternatively, the first liquid may include a binder resin and/or a combination of a compound having an active hydrogen group with a polymer having a functional group reactive with the active hydrogen group.

In the latter case, a reaction between the compound having an active hydrogen group and the polymer having a functional group reactive with the active hydrogen group may be caused during a process of preparing the second liquid.

The polymer having a functional group reactive with the active hydrogen group may be a polyester having an isocyanate group (hereinafter "prepolymer (A)").

The active hydrogen group in the compound may be, for example, hydroxyl group (e.g., alcoholic hydroxyl group, phenolic hydroxyl group), amino group, carboxyl group, or mercapto group.

According to an embodiment, the compound having an active hydrogen group is an amine (B) and the polymer having a functional group reactive with the active hydrogen group is the prepolymer (A) having an isocyanate group.

The prepolymer (A) reacts with the amine (B) to produce an urea-modified polyester. The amine (B) functions as a cross-linking agent and/or an elongating agent. It is easy to control the molecular weight of the resultant urea-modified resin, especially of high-molecular-weight components therein. A toner including such an urea-modified polyester can be advantageously fixed on a recording medium at low temperatures without applying oil to a fixing member. In particular, an urea-modified polyester, a terminal of which is modified with a urea group, can be fixed on a recording medium at low temperatures while keeping high fluidity and transparency.

The prepolymer (A) can be obtained by reacting a polyester having an active hydrogen group with a polyisocyanate (PIC). The active hydrogen group in the polyester may be, for example, hydroxyl group (e.g., alcoholic hydroxyl group, phenolic hydroxyl group), amino group, carboxyl group, or mercapto group.

A polyester having an alcoholic hydroxyl group can be obtained from a polycondensation between a polyol (PO) and a polycarboxylic acid (PC).

The polyol (PO) may be, for example, a diol (DIO), a polyol (TO) having 3 or more valences, or a mixture of a diol (DIO) with a polyol (TO) having 3 or more valences.

Specific examples of the diol (DIO) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A, bisphenol F, bisphenol S), alkylene oxide (e.g., ethylene oxide, propylene oxide, butylene oxide) adducts of the alicyclic diols, and alkylene oxide (e.g., ethylene oxide, propylene oxide, butylene oxide) adducts of the bisphenols. Two or more of these diols can be used in combination.

In some embodiments, an alkylene glycol having 2 to 12 carbon atoms, an alkylene oxide adduct of a bisphenol, or a mixture of an alkylene oxide adduct of a bisphenol with an alkylene glycol having 2 to 12 carbon atoms is used.

Specific examples of the polyol (TO) having 3 or more valences include, but are not limited to, polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide (e.g., ethylene oxide, propylene oxide, butylene oxide) adducts of the polyphenols having 3 or more valences.

The polycarboxylic acid (PC) may be, for example, a dicarboxylic acid (DIC), a polycarboxylic acid (TC) having 3 or more valences, or a mixture of a dicarboxylic acid (DIC) with a polycarboxylic acid (TC) having 3 or more valences are preferable.

Specific examples of the dicarboxylic acid (DIC) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). Two or more of these dicarboxylic acids can be used in combination. In some embodiments, an alkenylene dicarboxylic acid having 4 to 20 carbon atoms or an aromatic dicarboxylic acid having 8 to 20 carbon atoms is used.

Specific examples of the polycarboxylic acid (TC) having 3 or more valences include, but are not limited to, aromatic polycarboxylic acids having 9 to 20 carbon atoms (e.g., trimellitic acid, pyromellitic acid). Two or more of these polycarboxylic acids can be used in combination.

Additionally, anhydrides and lower alkyl esters (e.g., methyl ester, ethyl ester, isopropyl ester) of polycarboxylic acids (PC) are also usable as the polycarboxylic acid (PC).

The polyester having an alcoholic hydroxyl group may be obtained at 150 to 280° C., while optionally reducing pressure and removing the produced water, in the presence of an esterification catalyst (e.g., tetrabutoxy titanate, dibutyltin oxide). In this case, the equivalent ratio of hydroxyl groups in the polyol to carboxyl groups in the polycarboxylic acid may be within a range of 1 to 2, 1 to 1.5, or 1.02 to 1.3.

Specific examples of usable polyisocyanates (PIC) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, and polyisocyanates in which the isocyanate group is blocked with a phenol derivative, an oxime, or caprolactam. Two or more of these polyisocyanates can be used in combination.

When reacting the polyester having an alcoholic hydroxyl group with the polyisocyanate (PIC), the reaction temperature may be within a range of 40 to 140° C. In this case, the equivalent ratio of isocyanate groups in the polyisocyanate (PIC) to alcoholic hydroxyl groups in the polyester may be within a range of 1 to 5, 1.2 to 4, or 1.5 to 2.5. When the equivalent ratio exceeds 5, low-temperature fixability of the resulting toner may deteriorate. When the equivalent ratio falls below 1, hot offset resistance of the resulting toner may deteriorate because the urea content in the urea-modified polyester may be too small.

When reacting the polyester having an alcoholic hydroxyl group with the polyisocyanate (PIC), a solvent may be added, if needed. Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), which are inactive with isocyanates.

In some embodiments, the prepolymer (A) has a weight average molecular weight within a range of 3,000 to 20,000. When the weight average molecular weight is less than 3,000, it may be difficult to control the reaction speed between the prepolymer (A) and the amine (B) and to reliably produce an urea-modified polyester. When the weight average molecular weight is greater than 20,000, hot offset resistance of the resulting toner may deteriorate because the prepolymer (A) may not sufficiently react with the amine (B).

In some embodiments, the content of polyisocyanate (PIC)-origin units in the prepolymer (A) is 0.5 to 40% by weight, 1 to 30% by weight, or 2 to 20% by weight. When the content of polyisocyanate(PIC)-origin units is less than 0.5% by weight, hot offset resistance, heat-resistant storage stability, and low-temperature fixability of the resulting toner may be poor. When the content of polyisocyanate(PIC)-origin units is greater than 40% by weight, low-temperature fixability of the resulting toner may be poor.

In some embodiments, the average number of isocyanate groups included in one molecule of the prepolymer (A) is 1 or more, from 1.5 to 3, or from 1.8 to 2.5. When the average number of isocyanate groups is less than 1, hot offset resistance of the resulting toner may be poor because the molecular weight of the resulting urea-modified polyester may be too small.

The amine (B) may be, for example, a diamine (B1), a polyamine (B2) having 3 or more valences, an amino alcohol (B3), an amino mercaptan (B4), or an amino acid (B5), and a blocked amine (B6) in which the amino group is blocked. In some embodiments, a diamine (B1) or a mixture of a diamine (B1) with a polyamine (B2) having 3 or more valences is used.

Specific examples of usable diamines (B1) include, but are not limited to, aromatic diamines (e.g., phenylenediamine, diethyltoluenediamine, 4,4'-diaminophenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine). Two or more of them can be used in combination.

Specific examples of usable polyamines (B2) having 3 or more valences include, but are not limited to, diethylenetriamine and triethylenetetramine. Two or more of them can be used in combination.

Specific examples of usable amino alcohols (B3) include, but are not limited to, ethanolamine and hydroxyethylaniline. Two or more of them can be used in combination.

Specific examples of usable amino mercaptans (B4) include, but are not limited to, aminoethyl mercaptan and aminopropyl mercaptan. Two or more of them can be used in combination.

Specific examples of usable amino acids (B5) include, but are not limited to, aminopropionic acid and amino caproic acid. Two or more of them can be used in combination.

Specific examples of usable blocked amines (B6) include, but are not limited to, ketimine compounds obtained from amines and ketones (e.g., acetone, methyl ethyl ketone, methyl isobutyl ketone), and oxazoline compounds. Two or more of them can be used in combination.

When reacting the prepolymer (A) with the amine (B), a catalyst (e.g. dibutyltin laurate, dioctyltin laurate) may be used, if needed. The reaction time between the prepolymer (A) and the amine (B) may be 10 minutes to 40 hours, or 2 to 24 hours. The reaction temperature may be within a range of 0 to 150° C., or 40 to 98° C.

When reacting the prepolymer (A) with the amine (B), the equivalent ratio of isocyanate groups in the prepolymer (A) to amino groups in the amine (B) may be within a range of 0.5 to 2, 2/3 to 1.5, or 5/6 to 1.2. When the equivalent ratio is greater than 2 or less than 0.5, hot offset resistance of the toner may be poor because the molecular weight of the resulting urea-modified polyester may be too small.

The reaction between the prepolymer (A) and the amine (B) may be terminated with a reaction terminator for the purpose of controlling the molecular weight of the resulting urea-modified polyester.

Specific examples of usable reaction terminators include, but are not limited to, monoamines (e.g., diethylamine, dibutylamine, butylamine, laurylamine) and those in which the amino group is blocked (e.g., ketimine compounds).

The first liquid may further include a modified polyester (e.g., a urea-modified polyester, a urethane-modified polyester) either in place of or in combination with the prepolymer (A).

Usable urea-modified polyester may have urethane bonds other than urea bonds. In this case, the molar ratio of urethane bonds to urea bonds may be within a range of 0 to 9, 0.25 to 4, or 2/3 to 7/3. When the molar ratio exceeds 9, hot offset resistance of the resulting toner may be poor.

Usable urea-modified polyester can be obtained by, for example, reacting the prepolymer (A) with the amine (B), optionally in the presence of a catalyst (e.g., dibutyltin laurate, dioctyltin laurate). In this case, the reaction time may be 10 minutes to 40 hours, or 2 to 24 hours. The reaction temperature may be within a range of 0 to 150° C., or 40 to 98° C.

When reacting the prepolymer (A) with the amine (B), the equivalent ratio of isocyanate groups in the prepolymer (A) to amino groups in the amine (B) may be within a range of 0.5 to 2, 2/3 to 1.5, or 5/6 to 1.2. When the equivalent ratio is greater than 2 or less than 0.5, hot offset resistance of the toner may be poor because the molecular weight of the resulting urea-modified polyester may be too small.

The reaction between the prepolymer (A) and the amine (B) may be terminated with a reaction terminator for the purpose of controlling the molecular weight of the resulting urea-modified polyester.

Specific examples of usable reaction terminators include, but are not limited to, monoamines (e.g., diethylamine, dibutylamine, butylamine, laurylamine) and those in which the amino group is blocked (e.g., ketimine compounds).

When reacting the prepolymer (A) with the amine (B), a solvent may be added, if needed. Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), which are inactive with isocyanates.

The used amount of the solvent may be within a range of 0 to 300 parts by weight, 0 to 100 parts by weight, or 25 to 75 parts by weight, based on 100 parts by weight of the prepolymer (A).

The modified polyester may have a weight average molecular weight within a range of 10,000 or more, 20,000 to 10,000,000, or 30,000 to 1,000,000. When the weight average molecular weight is less than 10,000, hot offset resistance of the resulting toner may be poor.

When the first liquid does not include any polyester resin, the modified polyester may have a number average molecular weight within a range of 2,000 to 15,000, 2,000 to 10,000, or 2,000 to 8,000. When the number average molecular weight is less than 2,000, paper having the resulting toner image thereon may wind around a fixing roller. When the number average molecular weight is greater than 15,000, the resulting toner may not be fixed at low temperatures and the resulting toner image may have low gloss.

The first liquid may further include a polyester either in place of or in combination with the prepolymer (A), to provide a toner having a good combination of heat-resistant storage stability and low-temperature fixability.

Usable polyester can be obtained from a polycondensation between the polyol (PO) and polycarboxylic acid (PC) described above.

THF-soluble components in the polyester may have a weight average molecular weight within a range of 1,000 to 30,000. When the weight average molecular weight of THF-soluble components is less than 1,000, it means that the polyester includes a large amount of oligomers, and therefore heat-resistant storage stability of the resulting toner may be poor. When the weight average molecular weight of THF-soluble components is greater than 30,000, and such a polyester is used in combination with the prepolymer (A), the prepolymer (A) cannot sufficiently react with the amine (B) due to steric hindrance. Therefore, offset resistance of the resulting toner may be poor.

The number and weight average molecular weights are converted from molecular weights of polystyrenes measured by gel permeation chromatography (GPC).

The polyester may have an acid value within a range of 1 to 50 KOHmg/g. When the acid value is less than 1 KOHmg/g, a basic compound cannot exert its dispersion stabilizing effect in the toner manufacturing processes. Moreover, when the polyester is included in the first liquid along with the prepolymer (A) and the amine (B), it is likely that the reaction between the prepolymer (A) and the amine (B) proceeds too much, resulting in poor manufacturing stability. When the acid value is greater than 50 KOHmg/g and the polyester is included in the first liquid along with the prepolymer (A) and the amine (B), it is likely that the reaction between the prepolymer (A) and the amine (B) proceeds insufficiently, resulting in a toner having poor offset resistance.

The acid value can be measured based on a method according to JIS K0070-1992.

The polyester may have a glass transition temperature within a range of 35 to 65° C. When the glass transition temperature is less than 35° C., heat-resistant storage stability of the resulting toner may be poor. When the glass transition temperature is greater than 65° C., low-temperature fixability of the resulting toner may be poor.

When the toner includes both the urea-modified polyester and the polyester, low-temperature fixability of the toner and glossiness of the resulting toner image improve. Such a toner can be obtained by, for example, dissolving the polyester in a solution in which the prepolymer (A) is reacted with the amine (B).

Further, the urea-modified polyester may be used in combination with the urethane-modified polyester.

In terms of low-temperature fixability and hot offset resistance, the urea-modified polyester and the polyester may be at least partially compatible with each other. Therefore, the urea-modified polyester and the polyester may have a similar chemical composition.

The weight ratio of the urea-modified polyester to the polyester may be within a range of 5/95 to 80/20, 5/95 to 30/70, 5/95 to 25/75, or 7/93 to 20/80. When the weight ratio is less than 5/95, hot offset resistance, heat-resistant storage stability, and low-temperature fixability of the resulting toner may be poor. When the weight ratio is greater than 80/20, low-temperature fixability of the resulting toner may be poor.

The content of the polyester in the total binder resin may be within a range of 50 to 100% by weight. When the content of the polyester is less than 50% by weight, heat-resistant storage stability and low-temperature fixability of the resulting toner may be poor.

According to some embodiments, the toner components may include a modified layered inorganic mineral in which metallic cations are at least partially exchanged with an organic cation.

For example, the modified layered inorganic mineral may be a layered inorganic mineral having a smectite-type basic crystal structure in which metallic cations are at least partially ion-exchanged with an organic cation. Such modified layer inorganic minerals control the shape of the resulting toner and improve chargeability of the resulting toner.

Specific examples of usable layered inorganic minerals include, but are not limited to, montmorillonite, bentonite, beidellite, nontronite, saponite, and hectorite. Two or more of these layered inorganic minerals can be used in combination.

Specific examples of usable organic cations include, but are not limited to, quaternary ammonium ions, phosphonium ions, and imidazolinium ions.

Specific examples of usable quaternary ammonium ions include, but are not limited to, trimethyl stearyl ammonium ion, dimethyl stearyl benzyl ammonium ion, dimethyl octadecyl ammonium ion, oleyl bis(2-hydroxyethyl) methyl ammonium ion.

Specific examples of commercially available modified layered inorganic minerals include, but are not limited to, BENTONE® 34, BENTONE® 52, BENTONE® 38, BENTONE® 27, BENTONE® 57, BENTONE® SD1, BENTONE® SD2, and BENTONE® SD3 (from Elementis Specialities); CLAYTONE® 34, CLAYTONE® 40, CLAYTONE® HT, CLAYTONE® 2000, CLAYTONE® AF, CLAYTONE® APA, and CLAYTONE® HY (from Southern Clay Products); S-BEN, S-BEN E, S-BEN C, S-BEN NZ, S-BEN NZ70, S-BEN W, S-BEN N400, S-BEN NX, S-BEN NX80, S-BEN NO12S, S-BEN NEZ, S-BEN N012, S-BEN WX, and S-BEN NE (from HOJUN Co., Ltd.); and KUNIBIS 110, 120, and 127 (from Kunimine Industries Co., Ltd.).

The modified layered inorganic mineral may be mixed and combined with the binder resin to be a composite (hereinafter "master batch"), before being added to the first liquid. The master batch can be prepared by mixing the modified layered inorganic mineral and the binder resin and kneading the mixture while applying a high shearing force thereto. An organic solvent can be further added to the mixture to increase the interaction between the modified layered inorganic mineral and the binder resin. When performing the mixing and kneading, a dispersing device capable of applying a high shearing force such as a three roll mill can be preferably used.

Alternatively, the master batch can be prepared by a flushing method in which an aqueous paste including the modified layered inorganic mineral is mixed and kneaded with the binder resin and an organic solvent so that the modified layered inorganic mineral is transferred to the binder resin side, and then the organic solvent and moisture contents are removed. Advantageously, the resulting wet cake of the modified layered inorganic mineral can be used as it is without being dried.

The modified layered inorganic mineral may have a volume average particle diameter within a range of 0.1 to 0.55 μm in the master batch. When the volume average particle diameter is less than 0.1 μm or greater than 0.55 μm, the shape and chargeability of the resulting toner cannot be sufficiently controlled.

Additionally, the content of the modified layered inorganic mineral having a volume average particle diameter of 1 μm or more in the master batch may be within a range of 0 to 15% by volume. When the content of the modified layered inorganic mineral having a volume average particle diameter of 1 μm or more is greater than 15% by volume, the shape and chargeability of the resulting toner cannot be sufficiently controlled.

The content of the modified layered inorganic mineral in the toner may be within a range of 0.1 to 5% by weight. When the content of the modified layered inorganic mineral is less than 0.1% by weight, the shape and chargeability of the resulting toner cannot be sufficiently controlled. When the content of the modified layered inorganic mineral is greater than 5% by weight, fixability of the resulting toner may be poor.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

The content of the colorant in the toner may be within a range of 1 to 15% by weight, or 3 to 10% by weight.

The colorant can be combined with a resin to be used as a master batch. The master batch can be prepared by mixing a resin and the colorant and kneading the mixture while applying a high shearing force thereto. An organic solvent can be further added to the mixture to increase the interaction between the colorant and the resin. When performing the mixing and kneading, a dispersing device capable of applying a high shearing force such as a three roll mill can be preferably used.

Alternatively, the master batch can be prepared by a flushing method in which an aqueous paste including the colorant is mixed and kneaded with the resin and an organic solvent so that the colorant is transferred to the resin side, followed by removal of the organic solvent and moisture contents. Advantageously, the resulting wet cake of the colorant can be used as it is without being dried.

Specific resins usable for the master batch include, but are not limited to, the above-described modified polyester, the polyester, styrene homopolymers (e.g., polystyrene, poly-p-chlorostyrene, polyvinyl toluene), styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resins, epoxy polyol resins, polyurethane, polyamide, polyvinyl butyral, polyacrylic acids, rosin, modified rosin, terpene resins, aliphatic or alicyclic hydrocarbon resins, aromatic petroleum resin, chlorinated paraffin, and paraffin wax. Two or more of such resins can be used in combination.

Specific examples of usable release agents include, but are not limited to, plant waxes (e.g., carnauba wax, cotton wax, sumac wax, rice wax), animal waxes (e.g., bees wax, lanolin), mineral waxes (e.g., ozokerite, ceresin), petroleum waxes (e.g., paraffin, microcrystalline, petrolatum), synthetic hydrocarbon waxes (e.g., Fischer-Tropsch wax, polyethylene wax), and synthetic waxes (e.g., ester, ketone, ether). Two or more of these release agents can be used in combination.

Additionally, fatty acid amides (e.g., 12-hydroxystearamide, stearamide, phthalimide anhydride, chlorinated hydrocarbon), low-molecular-weight crystalline polymers (e.g., homopolymers of polyacrylates such as poly-n-stearyl methacrylate and poly-n-lauryl methacrylate, and copolymers of polyacrylates such as n-stearyl acrylate-ethyl methacrylate copolymer), and crystalline polymers having a side chain having a long-chain alkyl group, are also usable as the release agent.

The release agent may have a melting point within a range of 50 to 120° C. Such a release agent improves hot offset resistance of the resulting toner even when no oil is applied to a fixing member. The melting point of the release agent can be determined from a maximum endothermic peak measured by differential scanning calorimetry (DSC).

The content of the release agent in the toner may be within a range of 1 to 20% by weight.

The first liquid includes an organic solvent. In some embodiments, the organic solvent has a boiling point less than 100° C. so as to be easily removed by evaporation. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. In some embodiments, an aromatic solvent (e.g., toluene, xylene) or a halogenated hydrocarbon (e.g., methylene chloride, 1,2-dichlorethane, chloroform, carbon tetrachloride) is used.

When the binder resin and/or a precursor thereof (e.g., a compound having an active hydrogen group and a polymer having a functional group reactive with the active hydrogen group) are soluble in the organic solvent, the first liquid has a low viscosity. When the first liquid has a low viscosity, toner particles having a narrow size distribution are produced.

The second liquid is prepared by emulsifying the first liquid in an aqueous medium. The aqueous medium may be, for example, water or a mixture of water and a water-miscible solvent. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

When the first liquid is emulsified in the aqueous medium to prepare the second liquid, a low-speed shearing disperser, a high-speed shearing disperser, a frictional disperser, a high-pressure jet disperser, or an ultrasonic disperser may be used, for example. When the high-speed shearing disperser is used, the revolution may be within a range of 1,000 to 30,000 rpm, or 5,000 to 20,000 rpm. The dispersing time may be within a range of 0.1 to 5 minutes.

The used amount of the aqueous medium may be within a range of 50 to 2,000 parts by weight, or 100 to 1,000 parts by weight, based on 100 parts by weight of solid contents in the first liquid. When the used amount of the aqueous medium is less than 50 parts by weight, the first liquid may not be finely dispersed in the aqueous medium, and therefore the resulting toner may not have a desired particle size. When the used amount of the aqueous medium is greater than 2,000 parts by weight, manufacturing cost may increase.

The aqueous medium may contain a dispersant, if needed. The dispersant narrows the size distribution of the resulting toner and stabilizes the second liquid. The dispersant may be, for example, a surfactant, an inorganic particle dispersant, or a resin particle dispersant.

Specific examples of usable surfactants include, but are not limited to, anionic surfactants (e.g., alkylbenzene sulfonates, α-olefin sulfonates, phosphates), amine-salt-type cationic surfactants (e.g., alkylamine salts, amino alcohol fatty acid derivatives, polyamine fatty acid derivatives, imidazoline), quaternary-ammonium-salt-type cationic surfactants (e.g., alkyl trimethyl ammonium salts, dialkyl dimethyl ammonium salts, alkyl dimethyl benzyl ammonium salts, pyridinium salts, alkyl isoquinolinium salts, benzethonium chloride), nonionic surfactants (e.g., fatty acid amide derivatives, polyvalent alcohol derivatives), and ampholytic surfactants (e.g., alanine, dodecyl di(aminoethyl) glycine, di(octylaminoethyl) glycine, N-alkyl-N,N-dimethylammonium betaine). Surfactants having a fluoroalkyl group are also usable. They are effective in small amounts.

Specific examples of anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl (C6-C10)-N-ethyl sulfonyl glycine salts, and monoperfluoroalkyl(C6-C16) ethyl phosphates.

Specific examples of commercially available anionic surfactants having a fluoroalkyl group include, but are not limited to, SURFLON® S-111, S-112, and S-113 (from AGC Seimi Chemical Co., Ltd.); FLUORAD™ FC-93, FC-95, FC-98, and FC-129 (from Sumitomo 3M); UNIDYNE™ DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of cationic surfactants having a fluoroalkyl group include, but are not limited to, aliphatic primary, secondary, and tertiary amine acids having a fluoroalkyl group; and aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts.

Specific examples of commercially available cationic surfactants having a fluoroalkyl group include, but are not limited to, SURFLON® S-121 (from AGC Seimi Chemical Co., Ltd.); FLUORAD® FC-135 (from Sumitomo 3M); UNIDYNE® DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Specific materials usable for the inorganic particle dispersant include, but are not limited to, tricalcium phosphate, calcium carbonate, titanium oxide, colloidal silica, and hydroxyapatite.

Specific materials usable for the resin particle dispersant include, but are not limited to, PMMA particles, polystyrene particles, and styrene-acrylonitrile copolymer particles.

Specific examples of commercially available resin particle dispersant include, but are not limited to, PB-200H (from Kao Corporation), SGP and SGP-3G (from Soken Chemical & Engineering Co., Ltd.), TECHPOLYMER SB (from Sekisui Plastics Co., Ltd.), and MICROPEARL (from Sekisui Chemical Co., Ltd.).

The inorganic or resin particle dispersant may be used in combination with a polymeric protection colloid. Specific examples of usable polymeric protection colloids include, but are not limited to, homopolymers and copolymers obtained from monomers, such as acid monomers (e.g., acrylic acid, methacrylic acid, α-cyanoacrylic acid, α-cyanomethacrylic acid, itaconic acid, crotonic acid, fumaric acid, maleic acid, maleic anhydride), acrylate and methacrylate monomers having a hydroxyl group (e.g., β-hydroxyethyl acrylate, β-hydroxyethyl methacrylate, β-hydroxypropyl acrylate, hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide), vinyl alcohol monomers, vinyl alcohol ether monomers (e.g., vinyl methyl ether, vinyl ethyl ether, vinyl propyl ether), ester monomers of vinyl alcohols with carboxylic acids (e.g., vinyl acetate, vinyl propionate, vinyl butyrate), amide monomers (e.g., acrylamide, methacrylamide, diacetone acrylamide) and methylol compounds thereof, acid chloride monomers (e.g., acrylic acid chloride, methacrylic acid chloride) and/or monomers containing nitrogen atom or a nitrogen-containing heterocyclic ring (e.g., vinyl pyridine, vinyl pyrrolidone, vinyl imidazole, ethylene imine); polyoxyethylenes (e.g., polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

The toner is obtained by evaporating the organic solvent from the second liquid, followed by washing and drying.

In some embodiments, the toner has a volume average particle diameter within a range of 3 to 7 μm. When the toner has a volume average particle diameter less than 3 μm and is used for a one-component developer, toner particles may undesirably form a film on a developing roller or fuse to a toner regulating blade. When such a toner is used for a two-component developer, toner particles may fuse to the surfaces of carrier particles when agitated in a developing device, resulting in deterioration of charging ability of the carrier particles. On the other hand, when the toner has a volume average particle diameter greater than 7 μm, it may be difficult to produce high-resolution and high-quality images. When such a toner is used for a two-component developer, the average particle diameter of toner particles in the developer may significantly vary as toner particles are consumed and supplied.

In some embodiments, the ratio of the volume average particle diameter (Dv) to the number average particle diameter (Dn) of the toner is within a range of 1.0 to 1.2. When the ratio is greater than 1.2, each toner particle may behave differently when developing an electrostatic latent image, resulting in a toner image with low micro-dot reproducibility.

The volume and number average particle diameters can be measured by a Coulter Counter.

In some embodiments, the content of toner particles having a particle diameter of 2 nm or less in the toner is 10% by number or less. When such a toner including particles having a particle diameter of 2 μm or less in an amount greater than 10% by number is used for a two-component developer, toner particles may fuse to the surfaces of carrier particles when agitated in a developing device, resulting in deterioration of charging ability of the carrier particles.

In some embodiments, the toner has an average circularity within a range of 0.94 to 0.99. When the average circularity is less than 0.94, it means that most of the toner particles have an irregular shape far from a sphere. Such a toner may not be effectively transferred from a photoreceptor onto a transfer material. When the average circularity is greater than 0.99, such a toner is difficult to remove from a photoreceptor or a transfer belt. As a result, the resultant image is contaminated with toner particles.

Both the content of particles having a particle diameter of 2 μm or less and the average circularity can be measured by a flow particle image analyzer.

Generally, a full-color copier develops a greater amount of toner particles on a photoreceptor compared to a monochrome copier. Therefore, in full-color copiers, it is difficult to increase transfer efficiency only by using irregular-shaped toner particles. Additionally, irregular-shaped toner particles are likely to fuse or adhere to the surfaces of a photoreceptor and/or an intermediate transfer member, because shear force and/or frictional force generate between the photoreceptor and a cleaning member, between the intermediate transfer member and a cleaning member, and/or between the photoreceptor and the intermediate transfer member. As a result, transfer efficiency is reduced. In such a case, toner images of cyan, magenta, yellow, and black each cannot be transferred uniformly. In particular, when an intermediate transfer member is used, the resulting toner image may have color unevenness. By contrast, a toner manufactured through the method according to an embodiment solves the above-described problems.

In some embodiments, the toner has a glass transition temperature within a range of 40 to 70° C. When the glass transition temperature is less than 40° C., the toner may cause blocking in a developing device or may form a film on a photoreceptor. When the glass transition temperature is greater than 70° C., the resulting toner may have poor low-temperature fixability.

In some embodiments, a charge controlling agent is fixed to the surface of the toner. For example, a charge controlling agent can be fixed to the surface of the toner by mixing the charge controlling agent with the toner in a container using a rotator. More specifically, the charge controlling agent may be mixed with the toner in a container having no projection on the inner wall surface using a rotator at a peripheral speed of from 40 to 150 m/sec.

Specific examples of usable charge controlling agents include, but are not limited to, nigrosine dyes, triphenylmethane dyes, chrome-containing metal complex dyes, molybdenum acid chelate pigments, rhodamine dyes, alkoxy amines, quaternary ammonium salts (including fluorine-modified quaternary ammonium salts), alkylamides, phosphor and phosphor-containing compounds, tungsten and tungsten-containing compounds, fluorine-containing surfactants, metal salts of salicylic acid, metal salts of salicylic acid derivatives, copper phthalocyanine, perylene, quinacridone, azo pigments, and polymers having a functional group such as a sulfonic group, a carboxyl group, and a quaternary ammonium salt group.

Specific examples of commercially available charge controlling agents include, but are not limited to, BONTRON® N-03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenylmethane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.

The content of the charge controlling agent in the toner may be within a range of 0.1 to 10 parts by weight, or 0.2 to 5 parts by weight, based on 100 parts by weight of the binder resin. When the content of the charge controlling agent is greater than 10 parts by weight, the resulting toner may generate too large an electrostatic attractive force between a developing roller, resulting in deterioration of fluidity of the toner and/or image density.

The charge controlling agent may be either added as a resin master batch or directly added to the first liquid.

According to an embodiment, inorganic particles are further fixedly adhered to the surface of the toner to improve fluidity, developability, and chargeability. Specific examples of usable inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Two or more of these materials can be used in combination. In some embodiments, hydrophobized silica particles and hydrophobized titanium oxide particles are used in combination. The average particle diameter of the hydrophobized silica particles and hydrophobized titanium oxide particles may be 50 nm or less. Such inorganic particles are unlikely to release from the toner particles even when agitated in a developing device.

The inorganic particles may have an average primary particle diameter within a range of 5 nm to 2 μm, or 5 to 500 nm. The inorganic particles may have a BET specific surface area within a range of 20 to 500 $m^2/g$.

The content of the inorganic particles in the toner may be within a range of 0.01 to 5% by weight, or 0.01 to 2.0% by weight.

A toner manufactured by the method according to an embodiment can be mixed with a magnetic carrier to be used as a two-component developer. The amount of the toner in the two-component developer may be 1 to 10 parts by weight based on 100 parts by weight of the magnetic carrier.

The magnetic carrier may be, for example, powders of iron, ferrite, or magnetite, having a particle diameter of about 20 to 200 μm.

The surface of the magnetic carrier may have covered with a resin. Specific usable resins include, but are not limited to, amino resins (e.g., urea-formaldehyde resins, melamine resins, benzoguanamine resins, urea resins, polyamide resins, epoxy resins), polyvinyl and polyvinylidene resins (e.g., acrylic resins, polymethyl methacrylate, polyacrylonitrile, polyvinyl acetate, polyvinyl alcohol, polyvinyl butyral), polystyrene resins (e.g., polystyrene, styrene-acrylic copolymer resins), halogenated olefin resins (e.g., polyvinyl chloride), polyethylene, polyvinyl fluoride, polyvinylidene fluoride, polytrifluoroethylene, polyhexafluoropropylene, vinylidene fluoride-acrylic copolymer, vinylidene fluoride-vinyl fluoride copolymer, fluoroterpolymers such as tetrafluoroethylene-vinylidene fluoride-nonfluorinated monomer terpolymer), polyesters (e.g., polyethylene terephthalate, polybutylene terephthalate), polycarbonates, and silicone resins.

The resin may include conductive powders therein. Specific examples of usable conductive powders include, but are not limited to, metal powders, carbon black, titanium oxide, tin oxide, and zinc oxide.

The conductive powders may have an average particle diameter of 1 μm or less. When the average particle diameter is greater than 1 μm, it is difficult to control electrical resistance.

Alternatively, the toner manufactured by the method according an embodiment can be used as a one-component developer without being mixed with a magnetic carrier.

Such one-component or two-component developers comprising the toner manufactured by the method according to an embodiment can be used for any image forming apparatuses.

Figure 3:
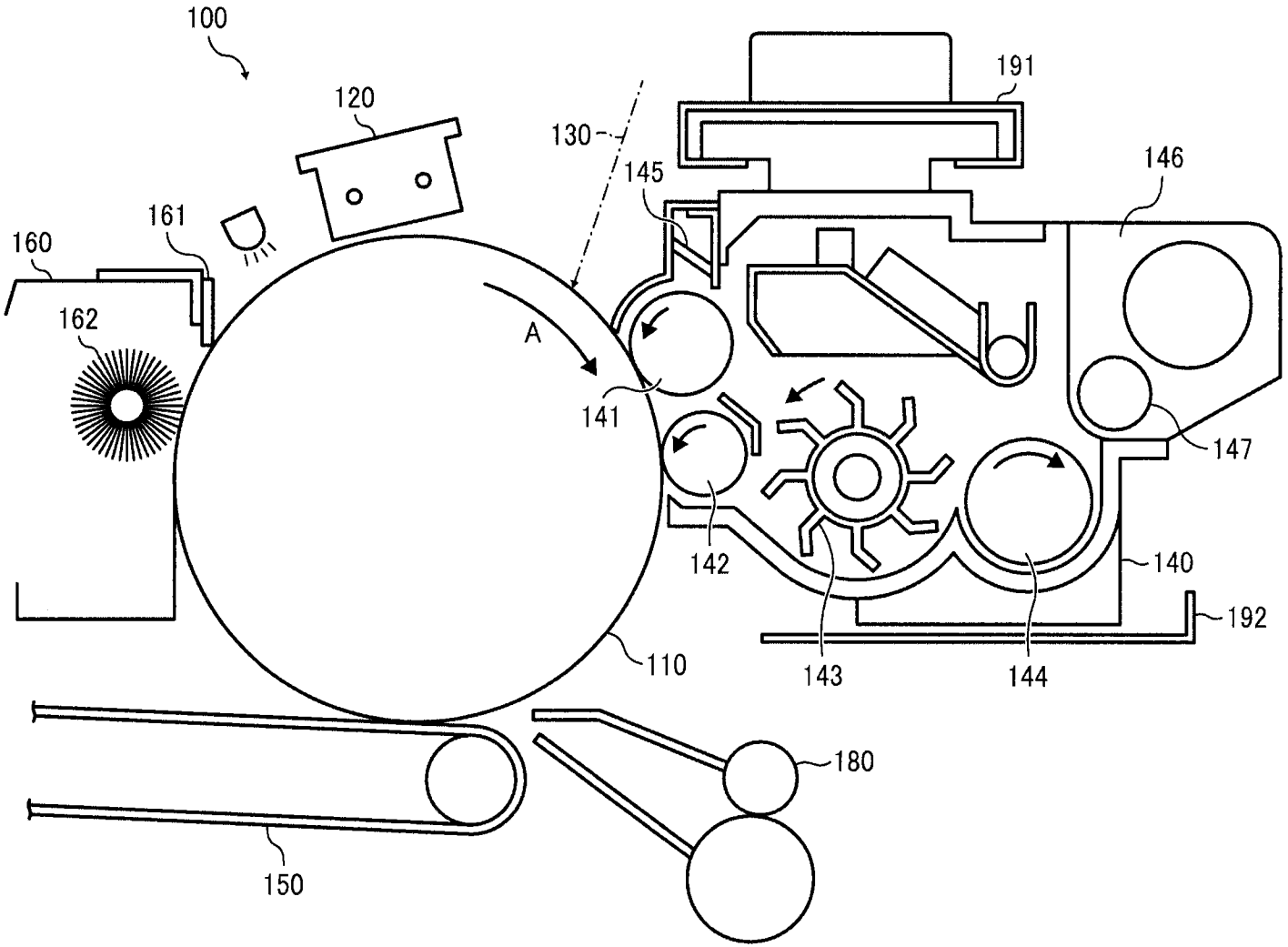
FIG. 3 is a schematic view illustrating an electrophotographic image forming apparatus to which the toner manufactured by a method according to an embodiment is applicable.

FIG. 3 is a schematic view illustrating an electrophotographic image forming apparatus to which the toner manufactured by the method according to an embodiment is applicable.

In an image forming apparatus 100, a photoreceptor 110 rotates in a direction indicated by arrow A in FIG. 3. The photoreceptor 110 is charged by a charger 120 and then exposed to a laser light beam 130 containing image information. Around the photoreceptor 110, a developing device 140, a transfer device 150, a cleaning device 160, a neutralization lamp 170, and a paper feeder 180 are disposed. The developing device 140 includes developing rollers 141 and 142, an agitation paddle 143, an agitation member 144, a doctor 145, a toner supply part 146, a supply roller 147. The cleaning device 160 includes a cleaning blade 161 and a cleaning brush 162. Guide rails 191 and 192 are provided above and below the developing device 140 for attaching/detaching and supporting the developing device 140.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Preparation of Particulate Resin Dispersion

Charge a reaction vessel equipped with a stirrer and a thermometer with 683 parts of water, 11 parts of a sodium salt of a sulfate of ethylene oxide adduct of methacrylic acid (ELEMINOL RS-30 from Sanyo Chemical Industries, Ltd.), 83 parts of styrene, 83 parts of methacrylic acid, 110 parts of butyl acrylate, and 1 part of ammonium persulfate. Agitate the mixture for 15 minutes at a revolution of 400 rpm. Thus, a whitish emulsion is prepared. Heat the emulsion to 75° C. and subject it to a reaction for 5 hours. Thereafter, add 30 parts of a 1% aqueous solution of ammonium persulfate thereto. Age the resulting mixture for 5 hours at 75° C. Thus, an aqueous dispersion of a vinyl resin (i.e., a copolymer of styrene, methacrylic acid, butyl acrylate, and a sodium salt of a sulfate of ethylene oxide adduct of methacrylic acid) is prepared. This dispersion is hereinafter called as the particulate resin dispersion 1. Resin particles in the particulate resin dispersion 1 have a volume average particle diameter of 105 nm when measured by a laser diffraction particle size distribution analyzer LA-920 (from Horiba, Ltd.). The resin isolated from the particulate resin dispersion 1 by drying has a glass transition temperature of 59° C. and a weight average molecular weight of 150,000.

Preparation of Polyester

Charge a reaction vessel equipped with a condenser, a stirrer, and a nitrogen inlet pipe with 229 parts of ethylene oxide 2 mol adduct of bisphenol A, 529 parts of propylene oxide 3 mol adduct of bisphenol A, 208 parts of terephthalic acid, 46 parts of isophthalic acid, and 2 parts of dibutyl tin oxide. Subject the mixture to a reaction for 5 hours at 230° C. under normal pressure. Subsequently, subject the mixture to a reaction for 5 hours under reduced pressures of 10 to 15 mmHg. Thereafter, add 44 parts of trimellitic anhydride thereto and further subject the mixture to a reaction for 2 hours at 180° C. under normal pressure. Thus, a polyester 1 is prepared. The polyester 1 has a glass transition temperature of 45° C. and an acid value of 20 mgKOH/g. THF-soluble components in the polyester 1 have a weight average molecular weight of 5,200.

Preparation of Prepolymer

Charge a reaction vessel equipped with a condenser, a stirrer, and a nitrogen inlet pipe with 795 parts of ethylene oxide 2 mol adduct of bisphenol A, 200 parts of isophthalic acid, 65 parts of terephthalic acid, and 2 parts of dibutyl tin oxide. Subject the mixture to a reaction for 8 hours at 210° C. under nitrogen gas flow at normal pressure. Subsequently, subject the mixture to a reaction for 5 hours under reduced pressures of from 10 to 15 mmHg while removing the produced water, and then cool it to 80° C. After adding 1,300 parts of ethyl acetate and 170 parts of isophorone diisocyanate, further subject the mixture to a reaction for 2 hours. Thus, a prepolymer 1 is prepared. The prepolymer 1 has a weight average molecular weight of 5,000.

Preparation of Master Batch

Mix 1,200 parts of water, 174 parts of a quaternary-ammonium-ion-exchanged modified bentonite BENTONE® 57 (from Elementis Specialities), and 1,570 parts of the polyester 1 using a HENSCHEL MIXER (from Mitsui Mining and Smelting Co., Ltd.). Knead the resulting mixture for 30 minutes at 150° C. using a double roll kneader. Roll and cool the kneaded mixture. Pulverize the rolled mixture into particles using a pulverizer (from Hosokawa Micron Corporation). Thus, a master batch 1 is prepared. The modified bentonite has a volume average particle diameter of 0.4 μm in the master batch. The content of the modified bentonite particles having a particle diameter of 1 μm or more in the master batch is 2% by volume.

Preparation of First Liquid 1

Mix 23.4 parts of the prepolymer 1, 123.6 parts of the polyester 1, 20 parts of the master batch 1, and 80 parts of ethyl acetate. On the other hand, disperse 15 parts of a carnauba wax and 20 parts of a carbon black in 120 parts of ethyl acetate using a bead mill over a period of 30 minutes. Mix the resulting two liquids using a TK HOMOMIXER for 5 minutes at a revolution of 12,000 rpm, and subsequently subject it to a dispersion treatment using a bead mill for 10 minutes. After adding 2.9 parts of isophoronediamine to the resulting dispersion liquid, agitate it using a TK HOMOMIXER for 5 minutes at a revolution of 12,000 rpm. Thus, a first liquid 1 (toner components liquid 1) is prepared.

Preparation of First Liquid 2

Mix 23.4 parts of the prepolymer 1, 141.6 parts of the polyester 1, 7 parts of an organo-silica sol MEK-ST (from Nissan Chemical Industries, Ltd., having a solid content of 30% by weight and an average primary particle diameter of 15 nm), and 64 parts of ethyl acetate. On the other hand, disperse 15 parts of a carnauba wax and 20 parts of a carbon black in 120 parts of ethyl acetate using a bead mill over a period of 30 minutes. Mix the resulting two liquids using a TK HOMOMIXER for 5 minutes at a revolution of 12,000 rpm, and subsequently subject it to a dispersion treatment using a bead mill for 10 minutes. After adding 2.9 parts of isophoronediamine to the resulting dispersion liquid, agitate it using a TK HOMOMIXER for 5 minutes at a revolution of 12,000 rpm. Thus, a first liquid 2 (toner components liquid 2) is prepared.

Preparation of Aqueous Medium

Mix and agitate 529.5 parts of ion-exchange water, 70 parts of the particulate resin dispersion 1, and 0.5 parts of sodium dodecylbenzenesulfonate using a TK HOMOMIXER at a revolution of 12,000 rpm. Thus, an aqueous medium 1 is prepared.

Preparation of Second Liquid

Continuously add 80 kg of the first liquid 1 to 120 kg of the aqueous medium 1 while agitating them. Thus, 200 kg of a second liquid 1 (emulsion 1) is prepared. The second liquid 1 has a viscosity of 500 mPa·sec when measured with a Brookfield viscometer at a revolution of 60 rpm and a temperature of 25° C. The content of ethyl acetate in the second liquid is 20% by weight. The solid content of the second liquid 1 is 22% by weight.

Evaporation of Organic Solvent

Evaporate the organic solvent from the second liquid 1 using the solvent removing apparatus 1 illustrated in FIG. 1, in which the inner pipe 6 and the depressurized water vapor supply opening 5 are concentrically disposed as illustrated in FIG. 2, under the following conditions.

Open the depressurized water vapor pressure regulating valve 15 so as to set the temperature of the inner wall surface of the inner pipe 6 to 45° C. and the vapor supply to 9.3 kg/h. Set the inner pressure of the inner pipe 6 to 79 mmHg (10.5 kPa). Supply 180 kg of the second liquid 1 having a temperature of 18° C. to the apparatus 1 at a supply rate of 90 kg/h so that the second liquid is formed into a liquid film and heated at not higher than the glass transition temperature of the binder resin by contact with the inner wall surface of the inner pipe 6. Thus, the ethyl acetate is evaporated from the second liquid. The inner pipe 6 has a heat transfer area (S) of 0.27 $m^2$ and a length of 3 m. The heat transfer area has a diameter of 28.4 mm and a peripheral length (L) of 89.2 mm. It takes 2 hours to supply 180 kg of the second liquid 1 to the apparatus 1, in other words, to evaporate the ethyl acetate from the second liquid 1. The discharged second liquid from which the ethyl acetate has been removed (hereinafter the "slurry") has a weight of 153 kg. The content of residual ethyl acetate in the slurry is 2.3% by weight. The solid content in the slurry is 26.2% by weight. The slurry has a temperature not higher than 40° C.

Next, contain the slurry in a tank equipped with a jacket and age it while setting the water temperature of the jacket to 45° C., followed by filtration, washing, drying, and wind power classification. Thus, spherical mother toner particles are obtained.

Mix 100 parts of the mother toner particles with 0.25 parts of a charge controlling agent BONTRON® E-84 (from Orient Chemical Industries Co., Ltd.) for 2 minutes using a Q-type MIXER (from Mitsui Mining and Smelting Co., Ltd.) equipped with turbine type blades at a peripheral speed of 50 in/sec, followed by a pause for 1 minute. Repeat this operation for 5 times. Further, mix 0.5 parts of a hydrophobized silica H2000 (from Clariant Japan K.K.) therein for 30 seconds by the Q-type MIXER at a peripheral speed of 15 msec, followed by a pause for 1 minute. Repeat this operation for 5 times. Thus, a toner 1 is prepared.

Examples 2 to 5

Repeat the procedure in Example 1 except for changing various conditions as described in Table 1. Thus, toners 2 to 5 are prepared.

Example 6

Figure 4:
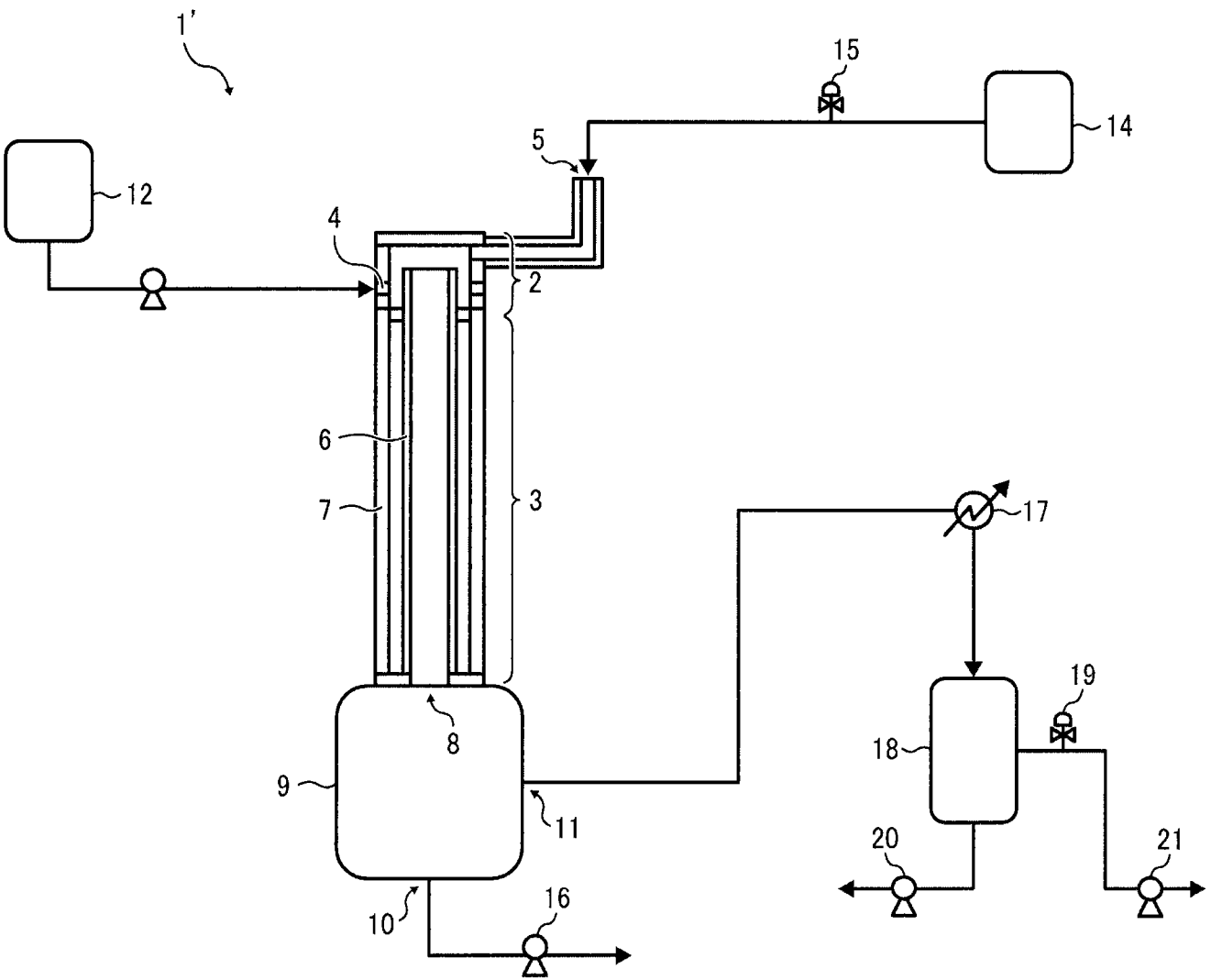
FIG. 4 is a schematic view illustrating another solvent removing apparatus for practicing a method of manufacturing toner according to an embodiment.

Repeat the procedure in Example 1 except for replacing the apparatus 1 with an apparatus 1' illustrated FIG. 4 in which the depressurized water vapor is supplied through a side wall surface of the supply part 2. It takes 2 hours to evaporate the ethyl acetate from the second liquid 1. The slurry (from which the ethyl acetate has been removed) has a weight of 160 kg. The content of residual ethyl acetate in the slurry is 4.8% by weight. The solid content in the slurry is 27.4% by weight. It is observed that toner particles are accumulated at the upper end of the heating part 3 of the inner pipe 6. Various conditions in Example 6 are also described in Table 1.

Comparative Example 1

Repeat the procedure in Example 1 except for flowing warm water having a temperature of 60° C. between the inner pipe 6 and the outer pipe 7 from a lower side to an upper side of the heating part 3 at a flow rate of 40 L/min in place of supplying the depressurized water vapor to the inner pipe 6. It takes 2 hours to evaporate the ethyl acetate from the second liquid 1. The slurry (from which the ethyl acetate has been removed) has a weight of 160 kg. The content of residual ethyl acetate in the slurry is 2.6% by weight. The solid content in the slurry is 27.4% by weight. It is observed that toner particles are accumulated at the lower end of the heating part 3 (shown by X in FIG. 1) of the inner pipe 6 and the bottom surface of the supply part 2 (shown by Y in FIG. 1). Various conditions in Comparative Example 1 are also described in Tables 1-1 and 1-2.

TABLE 1-1

| | Viscosity of Second Liquid (mPa · sec) | Heat Transfer Area of Inner Pipe ($m^2$) | Length of Inner Pipe (m) | Peripheral length of Inner Pipe (mm) | Supply Rate (kg/h) | Ethyl Acetate Content in Second Liquid (%) | Solid Content in Second Liquid* (%) |
|---|---|---|---|---|---|---|---|
| Example 1 | 500 | 0.27 | 3 | 28.4 | 90 | 20 | 22 |
| Example 2 | 500 | 0.27 | 3 | 28.4 | 120 | 20 | 22 |
| Example 3 | 500 | 0.27 | 3 | 28.4 | 120 | 20 | 22 |
| Example 4 | 500 | 0.27 | 3 | 28.4 | 150 | 20 | 22 |
| Example 5 | 500 | 0.27 | 3 | 28.4 | 120 | 20 | 22 |
| Example 6 | 500 | 0.27 | 3 | 28.4 | 100 | 20 | 22 |
| Comparative Example 1 | 500 | 0.27 | 3 | 28.4 | 100 | 20 | 22 |

*Organic solvent has not been removed from the second liquid.

TABLE 1-2

| | Vacuum (mmHg) (kPa) | Vapor Supply (kg/h) | Evaporation Time (min) | Slurry Temperature after Evaporation (° C.) | Residual Ethyl Acetate Content in Slurry after Evaporation (%) | Solid Content in Slurry after Evaporation (%) | Toner fusion on Heating Part of Inner Pipe |
|---|---|---|---|---|---|---|---|
| Example 1 | 79 (10.5) | 9.3 | 120 | 40 or less | 2.3 | 26.2 | No |
| Example 2 | 82 (11.0) | 9.9 | 120 | 40 or less | 3.3 | 27.0 | No |
| Example 3 | 72 (9.6) | 7.0 | 120 | 40 or less | 5.1 | 26.6 | No |
| Example 4 | 80 (10.6) | 7.2 | 120 | 40 or less | 6.6 | 26.8 | No |
| Example 5 | 81 (10.8) | 1.5 | 120 | 40 or less | 16.1 | 24.5 | No |
| Example 6 | 79 (10.5) | 9.3 | 120 | 40 or less | 2.8 | 26.5 | Yes |
| Comparative Example 1 | 75 (10.0) | — | 120 | 40 or less | 2.6 | 27.4 | Yes |

Measurement of Number and Weight Average Molecular Weights

The number and weight average molecular weights of each toner are measured by gel permeation chromatography (GPC) as follows. Flow tetrahydrofuran at a flow rate of 1 ml/min in columns stabilized in a heat chamber at 40° C. Inject 50 to 200 μl of a tetrahydrofuran solution containing 0.05 to 0.6% by weight of a sample into the columns Calculate the number and weight average molecular weights from the number of counts detected by a refractive index detector with reference to a calibration curve compiled from multiple polystyrene standard samples. The multiple polystyrene standard samples include monodisperse polystyrene samples each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (obtainable from Pressure Chemical Company or Tosoh Corporation).

Measurement of Particle Size of Modified Inorganic Mineral in Master Batch

Put an amount of the master batch and an amount of the resin used for the master batch (i.e., the polyester 1) in ethyl acetate in which 5% by weight of a dispersant DISPER BYK-167 (from BYK Chemie) is dissolved, so that the weight ratio of the modified inorganic mineral to the total resin becomes 0.1. Agitate the mixture for 12 hours while adjusting the total content of the master batch and resin to 5% by weight of the total amount of the mixture.

Subject the mixture (i.e., a sample) to a measurement with a Laser Doppler Particle Size Analyzer NANOTRAC UPA-150EX (from Nikkiso Co., Ltd.) under the following conditions.

Displayed distribution: By volume
Number of channels: 52
Measuring time: 15 seconds
Refractive index of particles: 1.54
Temperature: 25° C.
Particle shape: Non-sphere
Viscosity (CP): 0.441
Refractive index of solvent: 1.37
Solvent: Ethyl acetate Load the sample while diluting it with ethyl acetate using a dropper or an injector so that a sample loading indicator indicates a value within a range of 1-100.

Measurement of Acid Value

Acid value is measured based on a method according to JIS K0070-1992 as follows. Add 0.5 g of a sample (i.e., a resin) to 120 ml of toluene. Agitate the mixture for about 10 hours at room temperature (23° C.) so as to dissolve the sample in the toluene. Use dioxane or tetrahydrofuran in place of toluene when the sample is insoluble in toluene. Further, add 30 ml of ethanol thereto.

Subject the resulting liquid to a measurement of acid value at 23° C. with an automatic potentiometric titrator DL-53 TITRATOR (from Mettler-Toledo International Inc.), electrodes DG113-SC (from Mettler-Toledo International Inc.), and an analysis software program LabX Light Version 1.00.000. The potentiometric titrator is calibrated with a mixed solvent of 120 ml of toluene and 30 ml of ethanol. The measurement settings are as follows.

Stir
Speed [%] 25
Time [s] 15
EQP Titration
Titrant/Sensor
Titrant CH3ONa
Concentration [mol/L] 0.1
Sensor DG115
Unit of measurement mV
Predispensing to volume
Volume [mL] 1.0
Wait time [s] 0
Titrant addition Dynamic
dE(set) [mV] 8.0
dV(min) [mL] 0.03
dV(max) [mL] 0.5
Measure mode Equilibrium controlled
dE [mV] 0.5
dt [s] 1.0
t(min) [s] 2.0
t(max) [s] 20.0
Recognition
Threshold 100.0
Steepest jump only No
Range No
Tendency None
Termination
at maximum volume [mL] 10.0
at potential No
at slope No
after number EQPs Yes
n=1
comb. termination condition No
Evaluation
Procedure Standard
Potential 1 No
Potential 2 No
Stop for reevaluation No Measurement of Residual Amount of Ethyl Acetate in Slurry First, prepare an internal standard solution by weighing 4 g of toluene in a measuring flask and diluting it with 500 mL of DMF. Next, dilute 1.5 g of a slurry with about 50 mL of DMF, and add 10 mL of the internal standard solution thereto using a pipette. Agitate the resulting diluted slurry by a stirrer for 4 minutes at a revolution of 400 rpm. Subsequently, set the diluted slurry to an automatic sampler of a gas chromatograph GC-2010 (from Shimadzu Corporation) and subject it to a measurement. Calculate the residual amount of ethyl acetate in the slurry from the ratio between toluene (i.e., the internal standard) and ethyl acetate by an internal standard method. The injection amount of the diluted slurry is 2.0 μL. The measurement conditions are as follows.

Sample Vaporizing Chamber
Injection mode: Split
Vaporizing chamber temperature: 180° C.
Carrier gas: He
Pressure: 40.2 kPa
Total flow: 56.0 mL/min
Column flow: 1.04 mL/min
Linear speed: 20.0 cm/sec
Purge flow: 3.0 mL/min
Split ratio: 50.0
Column
Name: ZB-50
Thickness of liquid phase: 0.25 μm
Length: 30.0 m
Inner diameter: 0.32 mmID Maximum temperature: 340° C.
Column Oven
Column temperature: 60° C.
Temperature program: hold at 60° C. for 6 minutes→heat at a rate of 60° C./min→hold at 230° C. for 5 minutes
Detector
Detector temperature: 250° C.
Makeup gas: N2/Air
Makeup flow rate: 30.0 mL/min
N2 flow rate: 47.0 mL/min
Air flow rate: 400 mL/min Measurement of Glass Transition Temperature Glass transition temperature is measured with an instrument RIGAKU THERMOFLEX TG8110 (from Rigaku Corporation) at a heating rate of 10° C./min as follows. Contain about 10 mg of a sample in an aluminum sampler. Put the sampler on a holder unit and set it in an electric furnace. Heat the sample from room temperature to 150° C. at a heating rate of 10° C./min, keep it at 150° C. for 10 minutes, cool it to room temperature, and left it for 10 minutes. Subsequently, reheat the sample to 150° C. at a heating rate of 10° C./min in nitrogen atmosphere (i.e., a DSC measurement). Determine the glass transition temperature with an analysis system of a TG-DSC system TAS-100 (from Rigaku Corporation) by detecting an intersection of the tangent line and the base line of the resulting endothermic curve.

Measurement of Number Average Particle Diameter (Dn) and Volume Average Particle Diameter (Dv)

Number average particle diameter (Dn) and volume average particle diameter (Dv) are measured with an instrument COULTER COUNTER TA-II (from Beckman Coulter, Inc.) connected to an interface (from The Institute of Japanese Union of Scientists & Engineers) and a personal computer PC9801 (from NEC Corporation) for calculating number and volume particle size distribution, as follows. First, add 0.1 to 5 ml of a surfactant (an alkylbenzene sulfonate NEOGEN SC-A from Dai-ichi Kogyo Seiyaku Co., Ltd.) to 100 to 150 ml of an electrolyte (ISOTON-II from Coulter Electrons Inc.). Thereafter, add 2 to 20 mg of a sample to the electrolyte and disperse the sample using an ultrasonic disperser for about 1 to 3 minutes. Subject the resulting suspension liquid to a measurement of number and volume average particle diameters by the above instrument equipped with an aperture of 100 μm. The channels include the following 13 channels:

from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Accordingly, particles having a particle diameter of not less than 2.00 μm and less than 40.30 μm are measurable.

Measurement of Content of Particles having a Particle Diameter of 2 μm or Less

Average circularity and the content of particles having a particle diameter of 2 μm or less are measured with a flow particle image analyzer FPIA-2100 and an analysis software program FPIA-2100 Data Processing Program for FPIA version 00-10 (from Sysmex Corporation) as follows. First, mix 0.1 to 0.5 ml of a 10% surfactant (an alkylbenzene sulfonate NEOGEN SC-A from Dai-ichi Kogyo Seiyaku Co., Ltd.) and 0.1 to 0.5 g of a sample with a micro spatula in a 100-ml glass beaker. Further mix 80 ml of ion-exchange water therein. Subject the resulting dispersion liquid to a measurement of average circularity and the content of particles having a particle diameter of 2 μm or less when the dispersion liquid includes 5,000 to 15,000 particles per micro liter after being dispersed with an ultrasonic disperser (from Honda Electronics Co., Ltd.) for 3 minutes.

In the same manner, measure the content (% by number) of particles having a particle diameter of 3.17 μm or less and the content (% by volume) of particles having a particle diameter of 8 μm or more.

Evaluation of Image Density

Set each toner in a digital full-color copier IMAGIO COLOR 2800 (from Ricoh Co., Ltd.) and continuously print an image chart having an image area of 50% on 150,000 sheets of paper at monochrome mode. Thereafter, print a solid image on a sheet of a paper TYPE 6000 (from Ricoh Co., Ltd.) and measure image density of the solid image with an instrument X-Rite (from X-Rite). The evaluation results are graded as follows.

Rank A+: Not less than 1.8 and less than 2.2.

Rank A: Not less than 1.4 and less than 1.8.

Rank B: Not less than 1.2 and less than 1.4.

Rank C: Less than 1.2.

Evaluation of Image Granularity and Sharpness

Set each toner in a digital full-color copier IMAGIO COLOR 2800 (from Ricoh Co., Ltd.) and produce a monochrome photographic image. Visually observe the produced image to evaluate image granularity and sharpness. The evaluation results are graded as follows.

Rank A+: Similar to offset printing quality.

Rank A: Slightly inferior to offset printing quality.

Rank B: Considerably inferior to offset printing quality.

Rank C: Similar to conventional electrophotographic image quality. (Very poor.)

Evaluation of Background Fouling

Set each toner in a digital full-color copier IMAGIO COLOR 2800 (from Ricoh Co., Ltd.) and continuously print an image chart having an image area of 50% on 30,000 sheets of paper at monochrome mode. Thereafter, bring the copier to a stop while the copier is producing a white solid image. Transfer toner particles remaining on the photoreceptor onto a tape.

Subject the tape having the toner particles and a blank tape to a measurement of image density with a 938 spectrodensitometer (from X-Rite).

Evaluate the degree of background fouling in terms of the difference in image density between the tape having toner particles and the blank tape. The evaluation results are graded into four ranks: A (best), B, C, and D (worse).

Evaluation of Toner Scattering

Set each toner in a digital full-color copier IMAGIO COLOR 2800 (from Ricoh Co., Ltd.) and continuously print an image chart having an image area of 50% on 50,000 sheets of paper at monochrome mode. Visually observe the inside of the copier to evaluate the degree of toner scattering (toner contamination). The evaluation results are graded as follows.

Rank A: No problem.

Rank B: A slight amount of scattered toner particles is observed, but no problem in practical use.

Rank C: A considerable amount of scattered toner particles is observed. Not suitable for practical use.

Evaluation of Cleanability

Transfer residual toner particles remaining on the photoreceptor even after being cleaned onto a white paper by a SCOTCH® TAPE (from 3M).

Subject the white paper having the transferred toner particles thereon and a blank white paper to a measurement of reflected density with a Macbeth reflective densitometer RD514. Cleanability is evaluated in terms of the difference in reflected density between the white paper having toner particles and the blank white paper. The evaluation results and graded into the following two ranks.

Rank A: The difference is less than 0.01.

Rank C: The difference is not less than 0.01.

Evaluation of Charge Stability

Set each toner in a digital full-color copier IMAGIO COLOR 2800 (from Ricoh Co., Ltd.) and continuously print an image chart having an image area of 7% on 100,000 sheets of paper at monochrome mode under a high-temperature and high-humidity condition (40° C., 90% RH) and a low-temperature and low-humidity condition (10° C., 15% RH). Collect a part of the developer at every 1000 sheets of printing, and subject it to measurement of toner charge quantity by a blow off method.

In the blow off method, contain 10 g of the toner and 100 g of a ferrite carrier in a stainless-steel pot such that they occupy 30% of its volume, and agitate them for 10 minutes at a revolution of 100 rpm at a temperature of 20° C. and a humidity of 50% RH. Subject the mixture to a measurement with an instrument TB-200.

Charge stability is evaluated in terms of variation in charge quantity as follows.

Rank A: The variation is less than 5 μC/g.

Rank B: The variation is not less than 5 μC/g and less than 10 μC/g.

Rank C: The variation is not less than 10 μC/g.

Evaluation of Minimum Fixable Temperature

Set each toner in a copier MF2200 (from Ricoh Co., Ltd.) employing a fixing roller that uses TEFLON®. Make copies on sheets of a paper TYPE 6200 (from Ricoh Co., Ltd.) while varying the fixing temperature and keeping the linear speed at 120-150 mm/sec, surface pressure at 1.2 kgf/cm$^2$, and nip width at 3 mm, to determine the minimum fixable temperature. The minimum fixable temperature is graded into the following five ranks.

Rank A+: Less than 140° C.

Rank A: Not less than 140° C. and less than 150° C.

Rank B+: Not less than 150° C. and less than 160° C.

Rank B: Not less than 160° C. and less than 170° C.

Rank C: Not less than 170° C.

Evaluation of Maximum Fixable Temperature

Set each toner in a copier MF2200 (from Ricoh Co., Ltd.) employing a fixing roller that uses TEFLON®. Make copies on sheets of a paper TYPE 6200 (from Ricoh Co., Ltd.) while varying the fixing temperature and keeping the linear speed at 50 mm/sec, surface pressure at 2.0 kgf/cm$^2$, and nip width at 4.5 mm, to determine the maximum fixable temperature. The maximum fixable temperature is graded into the following five ranks.

Rank A+: Not less than 200° C.

Rank A: Not less than 190° C. and less than 200° C.

Rank B+: Not less than 180° C. and less than 190° C.

Rank B: Not less than 170° C. and less than 180° C.

Rank C: Less than 170° C.

Evaluation of Heat-resistant Storage Stability

Store each toner at 50° C. for 8 hours, and then sieve it with a 42 mesh for 2 minutes. Heat-resistant storage stability is evaluated in terms of the residual rate of toner remaining on the sieve and graded as follows.

Rank A+: Less than 10%.

Rank A: Not less than 10% and less than 20%.

Rank B: Not less than 20% and less than 30%.

Rank C: Not less than 30%.

The evaluation results are shown in Table 2 and Tables 3-1 and 3-2.

TABLE 2

| | Particle Size Properties | | | | | Glass Transition |
|---|---|---|---|---|---|---|
| | Dv (μm) | Dv/Dn | 3.17 μm or less (% by number) | 8 μm or more (% by volume) | 2 μm or less (% by number) | Temperature of Toner (° C.) |
| Example 1 | 4.9 | 1.13 | 5.6 | 1.7 | 8.3 | 54 |
| Example 2 | 4.8 | 1.13 | 5.9 | 1.4 | 6.6 | 54 |
| Example 3 | 5.2 | 1.13 | 5.6 | 2.3 | 10.6 | 54 |
| Example 4 | 5 | 1.13 | 5.3 | 1.7 | 10.0 | 54 |
| Example 5 | 4.9 | 1.11 | 5.3 | 0.4 | 5.9 | 54 |
| Example 6 | 6.4 | 1.23 | 13.8 | 13.8 | 13.8 | 54 |
| Comparative Example 1 | 5.5 | 1.19 | 3.6 | 4.8 | 2 | 54 |

TABLE 3-1

| | Image Density | Image Granularity & Sharpness | Background Fouling | Toner Scattering | Clean-ability |
|---|---|---|---|---|---|
| Example 1 | A | B | B | B | A |
| Example 2 | A+ | A | A | A | A |
| Example 3 | A+ | A | A | A | A |

TABLE 3-1-continued

| | Image Density | Image Granularity & Sharpness | Background Fouling | Toner Scattering | Clean-ability |
|---|---|---|---|---|---|
| Example 4 | A+ | A | A | A | A |
| Example 5 | A+ | A | A | A | A |
| Example 6 | A+ | A | A | A | A |
| Comparative Example 1 | A | B | B | B | A |

TABLE 3-2

| | Charge Stability | | Fixability | | Heat-resistant |
|---|---|---|---|---|---|
| | HH | LL | Minimum Temp. | Maximum Temp. | Storage Stability |
| Example 1 | A | A | B | A+ | A |
| Example 2 | A | A | A+ | A+ | A |
| Example 3 | A | A | A+ | A+ | A |
| Example 4 | A | A | A+ | A+ | A |
| Example 5 | A | A | A+ | A+ | A |
| Example 6 | A | A | A+ | A+ | A |
| Comparative Example 1 | A | A | B+ | B+ | A |

Additional modifications and variations in accordance with further embodiments of the present invention are possible in light of the above teachings. It is therefore to be understood that within the scope of the appended claims the invention may be practiced other than as specifically described herein.

What is claimed is:

1. A method of manufacturing toner, comprising:

preparing a first liquid by dissolving or dispersing toner components in an organic solvent, the toner components including a colorant, a release agent, and one or both of a binder resin and a precursor thereof;

preparing a second liquid by emulsifying the first liquid in an aqueous medium; and evaporating the organic solvent from the second liquid, the evaporating including:

flowing down the second liquid as a liquid film in substantially a vertical direction along an inner wall surface of a pipe that is depressurized;

heating the liquid film at a temperature not higher than a glass transition temperature of the binder resin; and supplying the pipe with a depressurized water vapor from a supply opening disposed on an upper part of the pipe.

2. The method according to claim 1, wherein the precursor includes a compound having an active hydrogen group and a polymer having a functional group reactive with the active hydrogen group.

3. The method according to claim 1, wherein the pipe and the supply opening are concentrically disposed in substantially a vertical direction.

4. The method according to claim 1, wherein the toner components further include a modified inorganic layered inorganic mineral in which metallic cations are at least partially exchanged with an organic ion.

* * * * *